US005114759A

United States Patent [19]

Finnicum et al.

[11] Patent Number: 5,114,759

[45] Date of Patent: May 19, 1992

[54] APPARATUS AND METHOD FOR CURTAIN COATING

[75] Inventors: Douglas S. Finnicum; Edward R. Schickler, both of Webster; William J. Soules; Robert A. Wahlers, both of Rochester, all of N.Y.

[73] Assignee: Eastman Kodak Company, Rochester, N.Y.

[21] Appl. No.: 729,115

[22] Filed: Jul. 12, 1991

Related U.S. Application Data

[63] Continuation-in-part of Ser. No. 559,806, Jul. 30, 1990, abandoned.

[51] Int. Cl.[5] ..... B05D 1/30

[52] U.S. Cl. ..... 427/420; 118/300; 118/DIG. 4

[58] Field of Search ..... 427/420; 118/DIG. 4, 118/300

[56] References Cited

U.S. PATENT DOCUMENTS

| | | | |
|---|---|---|---|
| 4,128,667 | 12/1978 | Timson | 427/438 |
| 4,287,240 | 9/1981 | O'Connor | 427/402 |
| 4,716,058 | 12/1987 | Morin | 427/420 |

FOREIGN PATENT DOCUMENTS

| | | |
|---|---|---|
| 311082 | 3/1981 | Fed. Rep. of Germany . |
| 90/01178 | 2/1990 | PCT Int'l Appl. . |
| 694223 | 5/1978 | U.S.S.R. . |

*Primary Examiner*—Shrive Beck

*Assistant Examiner*—Alain Bashore

*Attorney, Agent, or Firm*—Carl F. Ruoff

[57] ABSTRACT

Apparatus for curtain coating a web or article includes a coating hopper, a support roller, guide rollers for leading the web to and from the support roller and an enclosure. Air which has been conditioned in respect of temperature, humidity and cleanliness is introduced into an upper region of the enclosure. Air flow controlling means are provided below the region into which the conditioned air is introduced. The flow controlling means serve to control the flow of air downwards so that it is uniform across a horizontal plane within the enclosure and has a speed of about 10 feed per minute in the region of the coating liquids in the curtain, that being a speed which will not cause disturbing effects on the liquids in the curtain. The enclosure prevents random air currents of uncontrolled velocity, temperature and cleanliness impinging on the liquids in the curtain and on the slide, which might otherwise adversely affect the product coating. The change of air and the humidity selected for the incoming air keep the humidity within the enclosure at acceptable levels, the humidity tending to increase by virtue of evaporation of the solvent or vehicle in the coating liquid. The air passes out of the enclosure well below the curtain, in the lowest region of the enclosure. The air in the enclosure is at a temperature approximating to that of the coating liquids. In this way condensation of evaporated solvent or vehicle on equipment above and around the liquid curtain, is avoided.

16 Claims, 3 Drawing Sheets

APPARATUS AND METHOD FOR CURTAIN COATING

CROSS REFERENCE TO RELATED APPLICATION

This application is a continuation-in-part of application Ser. No. 07/559,806, filed Jul. 30, 1990, now abandoned.

BACKGROUND OF THE INVENTION

1. Field of the Invention

This invention relates to curtain coating webs or articles with liquid.

2. Description Relative to the Prior Art

In the art of curtain coating, such as is conducted in the photographic industry for coating layers of materials onto a support web for forming photographic film and paper, it is known that air flow adjacent the curtain can disturb the curtain and cause defects in the coating on the web. It is also known that it is impossible to render a coating room free of air currents because it is necessary to change the atmosphere in the room, it is necessary for people to enter and leave the room through doors, and there are temperature differentials which cause air currents. Likewise, it has been found impossible to render a coating room completely free of dust and such dust gets caught up in the air currents and carried onto the coating liquids.

Attempts have been made to reduce the disturbing effects on the coating of such ambient air currents.

U.S. Pat. No. 4,287,240, issued Sep. 1, 1981 to Thomas R. O'Connor, describes a coating apparatus provided with a protective shield. The coating apparatus therein described includes a hopper for forming a layer of liquid and for forming the layer into a curtain falling under gravity. A web to be coated is trained about a support roller which is disposed with its axis of rotation parallel to the plane of the curtain and so that the curtain impinges on the web while the web is on the support roller. The web approaches and leaves the support roller substantially horizontally. Disposed about the hopper and extending down as far as just above the web approaching the support roller, is a foraminous shield. The shield is substantially box shaped, with its sixth, the bottom, side open. The shield is formed from fine-mesh metal screening and is of double walled construction. The shield was intended to diffuse air currents impinging thereon so that their velocity is decreased, with a resulting decrease in their ability to disturb the flow of coating liquid. Indeed, it has been found that the residual air currents are necessary to prevent the build-up of water or solvent vapor inside the shield, the water or solvent vapor having evaporated from the liquid intended to form the coating. However, it has been found that the protective shield described in U.S. Pat. No. 4,287,240 does no more than was intended of it, namely to reduce, but not eliminate, the effects of the ambient air currents. It has been found that it does not eliminate the adverse effects of currents in air around the hopper and curtain including disturbance of the curtain. Furthermore, the air contacting the liquids in the curtain is the air of the coating room which contains dust particles even though the most stringent efforts may be made to achieve clean air.

The specification of PCT International Patent Application Number PCT/US89/03082 which was published under International Publication Number WO 90/01178, with Kenneth Ruschak named as inventor, describes another form of shield for protecting the flow of liquid on a hopper slide surface. The shield in the Ruschak application is imperforate and is disposed in very close overlying relationship to the liquid flowing down the slide surface of the hopper. The Ruschak shield is intended not only to prevent currents in the ambient air impinging on the liquid on the slide surface, which impact would cause disturbances of the liquid flow which would result in imperfections in the coating on the web, but also to prevent convection currents immediately adjacent the liquid caused by a difference in the temperatures of the liquid and the surrounding air. Even such convection currents have been found to cause disturbances in the liquid flow on the slide surface which appear as imperfections in the coating on the web. The Ruschak shield does not overlay the major portion of even one side of the curtain and does nothing to protect the other side of the curtain. It is intended solely to prevent disturbance of the liquid on the slide surface.

Problems, in the form of defects in the coating, derived from air currents impinging on the liquid on the slide surface and in the falling curtain, and from dust, remain.

SUMMARY OF THE INVENTION

It is an object of the present invention to avoid the problems derived from air currents impinging on and disturbing the liquid on the slide surface and in the falling curtain.

The present invention overcomes these problems by providing an enclosure which provides a space around the hopper and the falling curtain, wherein the direction, velocity and quality of air flow may be controlled. Turbulence and dust content are examples of the quality of air flow.

If it is found that convection currents due to a difference in the temperature of the coating liquid and the air flowing in the enclosure occur, then the temperature of the air introduced into the enclosure is, in accordance with a preferred embodiment of the present invention, controlled so as to approximate the temperature of the falling liquid.

Advantageously, the humidity is controlled so that condensation within the enclosure is avoided.

It has been found that in certain coating processes, advantages are achieved if the velocity of the air flowing substantially vertically downwards around the falling liquids is about 10 feet per minute.

BRIEF DESCRIPTION OF THE DRAWINGS

An embodiment of the present invention will now be described, by way of example, with reference to the accompanying drawings, in which.

DESCRIPTION OF THE PREFERRED EMBODIMENT

Figure 1:
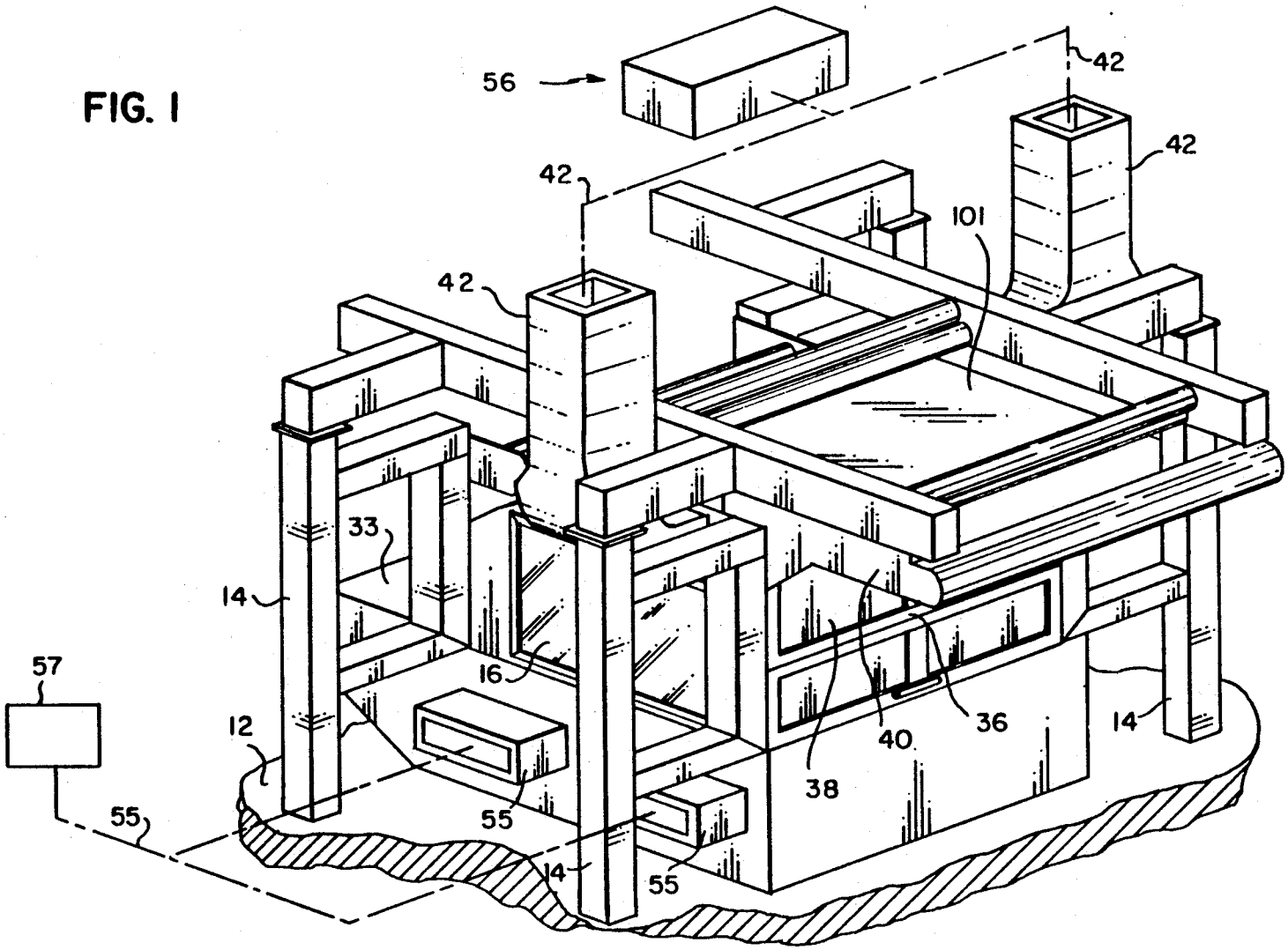
FIG. 1 is a perspective view from above and to a side, of apparatus in accordance with the present invention.
Figure 2:
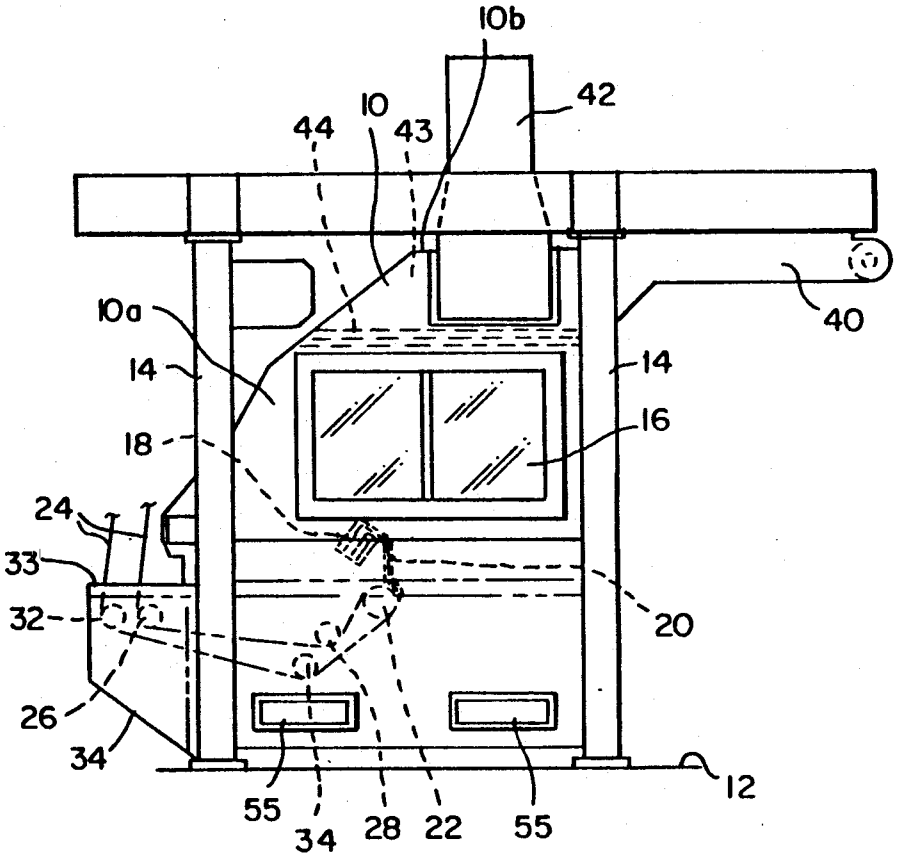
FIG. 2 is a side elevation of the apparatus represented in FIG. 1.

The apparatus illustrated in FIGS. 1 and 2 of the accompanying drawings, includes an enclosure 10 supported by columns 14 extending up from a floor 12. The enclosure 10 is imperforate and is formed of sheet metal except where a window 16 is provided. The window is glazed. The sheet metal is laminated with insulating material so that even if the temperature inside the enclosure is greater than that outside the enclosure and the humidity inside the enclosure is high, there can be no chance of condensation on the inside of the enclosure and hence there can be no chance of condensate falling as droplets within the enclosure.

Within the enclosure 10, and only schematically represented in FIG. 2, is a coating hopper 18, of known form, which forms liquids to be coated into a falling curtain 20. The hopper is disposed above a support roller 22, the axis of rotation of which is parallel to the plane of the curtain 20.

A web 24 to be coated is supported for movement through the curtain by means which in the present embodiment is the support roller 22, and its path to the support roller 22 is defined by guide rollers 26 and 28. The path of the web from the support roller 22 is defined by guide rollers 30 and 32. The guide rollers 26 and 32 are disposed below slots in an upwardly facing horizontal wall 33 of the enclosure 10. The slots allow passage of the web 24 into and out of the enclosure 10. The slots are slightly longer than the width of the web 24 and may be of the order of 1 inch wide.

The hopper 18, the support roller 22, the guide rollers 26, 28, 30, 32 and other ancillary equipment not shown and described herein but known by those skilled in the art to be necessary, are mounted on frame structure extending up from the floor and passing through the enclosure wall in sealed manner, or from the supports 14.

The shape of the upper left hand portion of the enclosure 10, as seen in FIG. 2, is not material to the present invention but is dictated by the presence of other equipment in this region.

The right hand, as seen in FIG. 2, wall 36 (visible in FIG. 1) of the enclosure is in part formed by a door 38 which can slide away upwards into an extension 40 of the enclosure 10.

Figure 3:
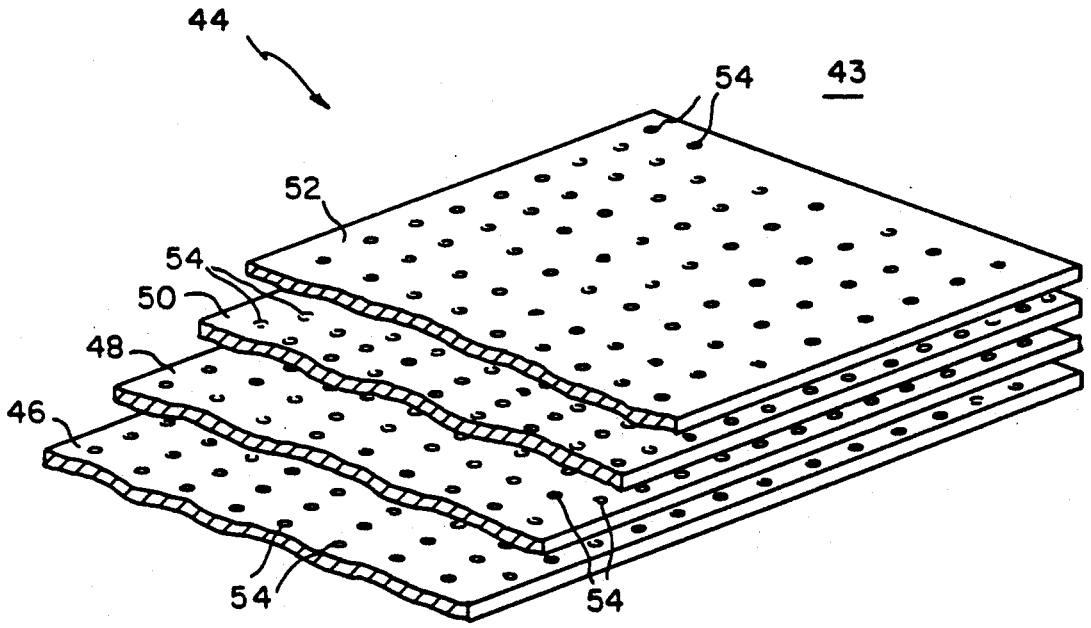
FIG. 3 is a perspective view of a component, in the form of air flow controlling means, of the apparatus within the enclosure.

Two ducts 42 are provided for the introduction of air to the uppermost region of the interior of the enclosure 10. Below the level of the bottom of the ducts 42, but well above the hopper 18, there is provided means 44 for controlling flow of air. The air flow controlling means 44 is schematically represented in FIG. 2 and is shown in FIG. 3 and comprises four plates 46, 48, 50, 52 which are disposed horizontally, one above the other, in spaced relationship from one another. Each of the plates is contiguous at its periphery with the enclosure 10. The plates serve to divide the interior of the enclosure into two chambers, that above the plates constituting a plenum chamber 43 into which air is introduced through the ducts 42 and that below the plates being the region within which the hopper 18, the support roller 22, and, in use, the curtain 20 are disposed.

The plates 46 to 52 have perforations 54 and it is arranged that perforations in adjacent plates are not aligned vertically. In this way, air introduced into the plenum chamber above the plates has to follow a tortuous path through perforations in adjacent plates as it flows downwards away from the plenum chamber. The total area of perforations 54 in each plate and the rate of feed of air through the ducts into the plenum chamber are so chosen that the air flow rate around the hopper 18 and liquid curtain 20 is uniform and the velocity is such that the falling liquid in the curtain is not disturbed, in other words, it is neither materially accelerated nor decelerated relative to a still air condition, and it is not deflected from a plane it would adapt free falling in still air. In one embodiment, the air velocity may be of the order of about 10 feet per minute, directed approximately vertically downwards. In the present embodiment, because the enclosure is not of uniform cross-sectional areas in different horizontal planes, the speed of the air flow just below the controlling means 44 is somewhat higher than the speed desired around the hopper and curtain. One particular form of air flow controlling means have been described which provide downstream flow speeds which are substantially uniform in a plane transverse to the direction of flow. However, it is to be understood that other forms of flow controlling means may be used and are well known to those skilled in the art.

There are means for allowing air to flow out of the lower region of the enclosure, which, in the present embodiment, are ducts 55 open to the interior of the enclosure. The positioning and relative sizing of the ducts 55 are so selected as to enhance the uniformity of flow rate and the approximately vertically downwards flow direction, around the hopper and curtain. The positions and relative sizes will vary from installation to installation. There are means associated with the ducts 55 for controlling the rate of flow of air out of the enclosure so that a pressure may be maintained in the enclosure 10 which is higher than the pressure outside the enclosure. In the present embodiment, the means for controlling the outflow rate includes blower means 57 which are so controlled as to maintain the supra-ambient pressure in the enclosure. The blower means is preferable over simple throttling means, in the present embodiment, because the outflowing air is ducted to a location external of the coating room because it contains solvents from the liquid which have evaporated into the air in the enclosure.

Diagrammatically represented at 56 in FIG. 1 are means for blowing air down the ducts 42 and for conditioning the air in humidity, temperature and cleanliness before it passes into the ducts 42.

In operation, web 24 is moved through the slot in the enclosure wall 33, to the support roller 22 about guide rollers 26, 28, passes around the support roller 22 and moves away from the support roller 22 about guide rollers 30, 32. After leaving the guide roller 32, the web passes through the other slot in the enclosure wall 33 to the exterior of the enclosure and thence onwards to driers and other devices. Liquids to be coated on the web 24 are supplied to the hopper 18 and, in known manner, are caused to flow out of slots in the inclined upper, slide surface of the hopper so that they flow down the slide surface as discrete layers, forming a composite layer which falls off the lip of the hopper. In falling off the lip of the hopper 18, the composite layer forms the falling curtain 20. The liquids in the curtain impinge on the web 24 where it is on the support roller 22 and form a uniform layer thereon.

Air is heated to a temperature somewhat in excess of the temperature of the liquids in the curtain 20, in the conditioning and blowing means 56. The excess temperature is to allow for cooling by the time the air is in the region of the liquid in the curtain 20. The humidity is adjusted in the means 56 so that no condensation occurs within the enclosure even though solvent or vehicle in the liquids in the curtain evaporates. The conditioning means also cleans the air thereby removing all particles which, if they became entrained in the coating liquids, would cause defects in the coated web. The means 56 also serve to blow conditioned air into the ducts 42 at a rate appropriate for causing an air speed within the enclosure adjacent the curtain of about 10 feet per minute. Air leaving the ducts 42 enters the plenum chamber 43 portion of the interior of the enclosure above the air flow controlling means 44 in the form of the plates 46, 48, 50, 52. Air flows downwards through the perforations 54 in the plates 46–52 and in so doing it is given a substantially uniform velocity. The rate of feed of air to the plenum is such as to produce an air speed in the region of the curtain of about 10 feet per minute. Such a speed is sufficient to prevent the build up of solvent or vehicle evaporating from the liquids in the curtain, but is not so high as to create any undesirable effects on the curtain. After passing downwards past the curtain and support roller, the air continues downwards into the lowest region of the enclosure 10 from which it leaves through the ducts 55. Because the change in air flow pattern associated with flowing out of the ducts 55 is well below the curtain, there is no adverse effect on the curtain caused by such change in flow pattern.

The air pressure within the enclosure 10 is maintained slightly above the pressure outside the enclosure so that air currents, perhaps containing dust particles and probably with a temperature and a humidity different to that delivered by the ducts 42, do not enter the enclosure through openings it may intentially or inadvertently have.

Because the air supplied to the interior of the enclosure has a temperature approximately that of the coating liquids, all equipment, such as the mounts for the hopper, the support roller and the guide rollers, is maintained at the same temperature as the coating liquids. Thus, there is nothing above the web adjacent the hopper or above the hopper which could rain droplets of condensed solvent or vehicle onto the web or the coating liquids. Even if there should be any condensation outside the enclosure and above the hopper, the enclosure acts as an umbrella.

While the preferred embodiment of the present invention has been described in which a web is coated with liquids, it is to be understood that the present invention is applicable to the coating of objects, such as, for example, sheets of material or three-dimensional bodies, with liquids.

The invention has been described in detail with particular reference to a presently preferred embodiment, but it will be understood that variations and modifications can be effected within the spirit and scope of the invention.

What is claimed is:

1. Apparatus for coating a web or object with a liquid, including:

a hopper for forming a layer of liquid and for forming said layer into a curtain falling under gravity;

means for supporting a web or object for movement through the curtain;

an enclosure enclosing said hopper and said means for supporting a web or object and, in use, the curtain;

means for introducing a flow of air into an upper region of said enclosure above said hopper; and means for allowing air to flow out of a lower region of the enclosure, whereby the flow of air is substantially vertically downwards in the region of the curtain and is of such low velocity that disturbance of the curtain is avoided.

2. Apparatus as claimed in claim 1, further including:

means for heating the air prior to introduction into the enclosure whereby the temperature of the air in the region of the curtain is approximately the same as the temperature of liquid in the curtain.

3. Apparatus as claimed in claim 1, wherein said means for introducing air is adapted to introduce air at a rate such that the velocity of the air around the falling curtain is about 10 feet per minute, whereby detrimental effects to the coating, caused by disturbance of the curtain by the air flow, are avoided.

4. Apparatus as claimed in claim 1, including:

means controlling the flow of air and adapted to form the flow of air introduced into the enclosure, into a non-turbulent substantially vertical downwards flow.

5. Apparatus as claimed in claim 1, wherein the means for allowing air to flow out of the lower region of the enclosure includes means to restrict the air flow whereby the pressure within the enclosure is higher than the pressure outside the enclosure.

6. Apparatus as claimed in claim 1, including:

means for adjusting the humidity of the air prior to introduction into the enclosure.

7. Apparatus as claimed in claim 6, wherein said means for introducing air is adapted to introduce air at a rate such that the velocity of the air around the falling curtain is about 10 feet per minute, whereby detrimental effects to the coating, caused by disturbance of the curtain by the air flow, are avoided.

8. Apparatus as claimed in claim 1, including:

means for cleaning the air prior to introduction into the enclosure.

9. A method of coating a web or object with a liquid, including:

providing a hopper for forming a layer of liquid and for forming said layer into a curtain falling under gravity;

supporting and moving said web or object through the curtain;

providing an enclosure around said hopper and the curtain and the web or object where it is impinged by the liquid in the curtain;

introducing a flow of air into an upper region of the enclosure; and allowing air to flow out of a lower region of the enclosure, whereby the flow of air is substantially vertically downwards in the region of the curtain and is of such low velocity that distrubance of the curtain is avoided.

10. A method as claimed in claim 9, including:

maintaining the pressure of air in the enclosure at a pressure above the pressure of air outside the enclosure.

11. A method as claimed in claim 9 or 10, including:

heating the air prior to introduction into the enclosure whereby the temperature of the air in the region of the curtain is approximately the same as the temperature of liquid in the curtain.

12. A method as claimed in claim 9 or 10, including:

introducing air into the enclosure at a rate such that the velocity of the air around the falling curtain is about 10 feet per minute, whereby detrimental effects to the coating, caused by disturbance of the curtain by the air flow, are avoided.

13. A method as claimed in claim 9 or 10, including:

controlling the flow of air so as to form the flow of air introduced into the enclosure into a non-turbulent substantially downwards flow of air around the curtain.

14. A method as claimed in claim 9 or 10, including: adjusting the humidity of the air to be introduced into the enclosure so that there is an absence both of condensation within the enclosure and of excessive evaporation of liquid from the curtain.

15. A method as claimed in claim 9 or 10, including controlling the rate and the humidity of the flow of air introduced into the enclosure, whereby there is an absence of condensation in the enclosure.

16. A method as claimed in claim 9 or 10, including cleaning the air to be introduced into the enclosure.

* * * * *